US008237041B1

(12) United States Patent
McCauley

(10) Patent No.: US 8,237,041 B1
(45) Date of Patent: Aug. 7, 2012

(54) SYSTEMS AND METHODS FOR A VOICE ACTIVATED MUSIC CONTROLLER WITH INTEGRATED CONTROLS FOR AUDIO EFFECTS

(76) Inventor: Jack J. McCauley, Danville, CA (US)

( * ) Notice: Subject to any disclaimer, the term of this patent is extended or adjusted under 35 U.S.C. 154(b) by 252 days.

(21) Appl. No.: 12/260,979

(22) Filed: Oct. 29, 2008

(51) Int. Cl.
*G10H 1/36* (2006.01)

(52) U.S. Cl. ..... 84/610

(58) Field of Classification Search ..... 84/610
See application file for complete search history.

(56) References Cited

U.S. PATENT DOCUMENTS 5,686,684 A * 11/1997 Nagata et al. ..... 84/631
7,060,885 B2 * 6/2006 Ishida et al. ..... 84/626
2007/0048711 A1 * 3/2007 Lee ..... 434/307 A
2009/0165634 A1 * 7/2009 Mahowald ..... 84/610
* cited by examiner

*Primary Examiner* — Jianchun Qin
(74) *Attorney, Agent, or Firm* — Kang Lim

(57) ABSTRACT

A voice activated music controller system, useful in association with a game system and a player is provided. The voice activated music controller system includes a voice activated controller, and a base station. The voice activated controller includes a transducer for receiving an audio signal, one or more sound effect controls, and a transmitter. The sound effect controls may be any of buttons, touch pads, roller balls, accelerometers and pressure sensors. The transmitter sends the audio signal and the control inputs to a receiver of the base station via a radio signal. A signal processor in the base station applies one or more sound effects to the audio signal according to the control inputs. These sound effects include one or more of a chorus effect, a pitch modulation, a pitch correction, a harmonizing effect, and a sound bite. This results in the generation of a processed audio signal which is outputted to the gaming system via a coupler.

21 Claims, 14 Drawing Sheets

SYSTEMS AND METHODS FOR A VOICE ACTIVATED MUSIC CONTROLLER WITH INTEGRATED CONTROLS FOR AUDIO EFFECTS

BACKGROUND OF THE INVENTION

The present invention relates to video game systems. More particularly, the present invention relates to a video game voice activated music controller including controls for the inclusion of audio feed processing and sound effect management.

Computer video games have evolved from the early games, such as "pong", played on a personal computer with a basic track ball type controller, to the present day sophisticated games which require a myriad of control devices. Recently, there has been an emergence of "real activity" gaming. These games aim to emulate common sports or activities and integrate them into a virtual environment. Performance on the activity may then be scored.

One category of these real life activity games includes the musical emulation games. Additional games, such as drumming games and, notably, karaoke, all fall within this category of games. For singing based games, such as karaoke, a microphone is required to generate a data signal from the user's voice. Typical microphones used in the gaming industry are standard wired microphones, such as the Logitech™ microphone model 981-000056.

When playing such games, users often "get lost" within the game. This may lead to vigorous movement and a general obliviousness as to their surroundings. The wire running from a microphone may impede an active singer from engaging in a wide range of movement, such as dancing along with the music. Additionally, a wire may pose a trip hazard for the singer.

Additionally, current microphones are designed to provide an audio input and, in some cases, they may include volume control. However, there are a number of game-type controls a game player may wish to be able to readily access. Traditional microphones do not provide the ability for a player to input game-like controls.

Hence there is a need for an improved voice activated music controller which enables a player to readily access an array of sound effects and audio manipulations. Additionally, there is a need for the improved voice activated music controller to be able to receive game-like inputs, such as button input and motion detection input. Lastly, such a voice activated music controller may be wireless to allow the player unhindered mobility and a reduced likelihood of injury.

SUMMARY OF THE INVENTION

To achieve the foregoing and in accordance with the present invention, a wireless game voice activated music controller having integrated user inputs for sound effect controls is provided. Such a voice activated music controller system may be useful in conjunction with gaming, education, the recording industry, musical performance and as a therapeutic tool.

One embodiment of the voice activated music controller system may be useful in association with a game system and a player. The voice activated music controller system includes a voice activated controller, and a base station. The voice activated controller includes a transducer for receiving an audio signal, one or more sound effect controls, and a transmitter.

The sound effect controls may be any of buttons, touch pads, roller balls, accelerometers and pressure sensors. These controls relate directly to the application of sound effects to the received audio signal. These sound effects include one or more of a chorus effect, a pitch modulation, a pitch correction, a harmonizing effect, and a sound bite.

The transmitter may send the audio signal and the control inputs from the sound effect controls to the base station via a radio signal. The transmitter may utilize any of interleaving, frequency differences, or headers to differentiate the audio signal from the control inputs. In some embodiments, the transmitter may send the audio signal and control inputs directly to the gaming system thereby omitting the base station.

The base station includes a receiver which receives the outputted audio signal and the one or more control inputs from the transmitter. A signal processor in the base station may then apply one or more sound effects to the audio signal according to the control inputs from the sound effect controls. This may result in the generation of a processed audio signal which may then be output to the gaming system via a coupler.

In some embodiments, the voice activated controller includes an effects processor for applying the sound effects to the audio signal according to the sound effects control inputs. In yet other embodiments, the gaming system receives the native audio signal and control inputs and may perform the sound effect processing.

Note that the various features of the present invention can be practiced alone or in combination. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention. The features and advantages of the present invention may be better understood with reference to the drawings and discussions that follow.

Figure 1:
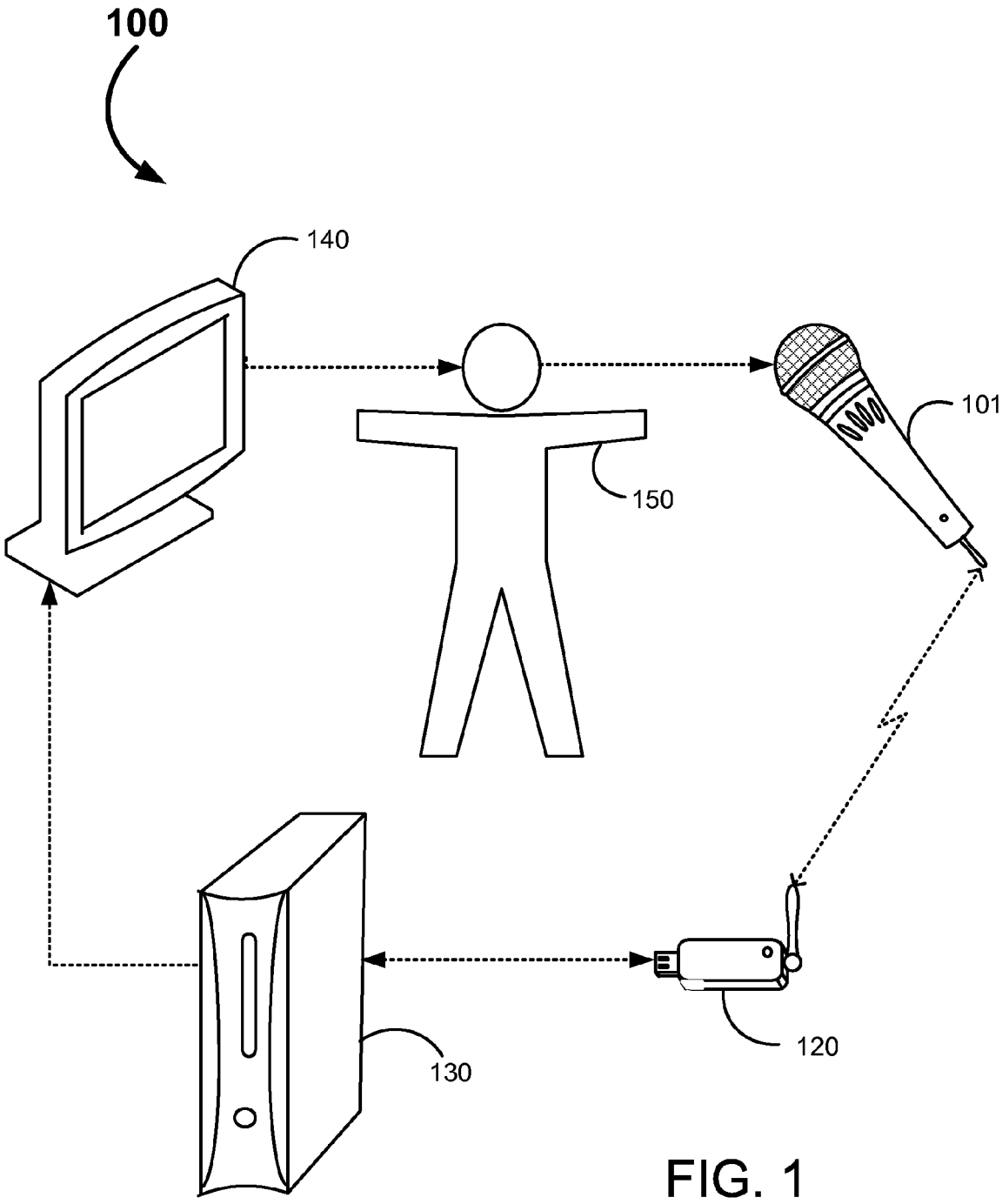
FIG. 1 illustrates a player using a voice activated music controller with integrated controls for audio effects in conjunction with a gaming system and a display in accordance with an embodiment of the present invention.

To facilitate discussion, FIG. 1 illustrates one embodiment of a Player 150 using a Voice Activated Music Controller with Integrated Sound Effect Controls 101 in conjunction with a Gaming System 130 and a Display 140, shown generally at 100. The Voice Activated Music Controller with Integrated Sound Effect Controls 101 may be held in the typical fashion by the Player 150. Audio signals are collected by the Voice Activated Music Controller with Integrated Sound Effect Controls 101. Audio signals may be collected as a mono signal, a stereo signal or as a surround signal. Additionally, the Player 150 may manipulate controls on the Voice Activated Music Controller with Integrated Sound Effect Controls 101 signifying particular audio conditioning or sound effects. The manipulation of these controls may be in response to some cue from the game being run on the Gaming System 130, or may be voluntary additions by the Player 150 to enhance the "style" of the performance.

Sound effects may include any of, but not limited to, pitch modulation, pitch correction, chorus, voice "echo" effects, addition of sound bites, or any other sound conditioning or effect.

The collected data may be transmitted by the Voice Activated Music Controller with Integrated Sound Effect Controls 101 to the Base Station 120. The Voice Activated Music Controller with Integrated Sound Effect Controls 101 may digitize the collected analog signals prior to transmission, or may transmit the data as an analog signal. Transmission may include interleaving of signals, multiple frequencies, data headers or any other reasonable technique to avoid mixing of the audio signals with the control signals.

The Base Station 120 may have an interface for sending data on to the Gaming System 130. In some embodiments, the interface may include a standard Universal Serial Bus (USB) connector. Alternatively, a Musical Instrument Device Interface (MIDI) connector may be utilized. In other embodiments, the interface may include a proprietary connector. Also, wireless technologies, such as blue tooth or infra red, may be utilized to send data from the Base Station 120 to the Gaming System 130. Likewise, the Base Station 120 may, in some embodiments, be configured to couple to an Ethernet or other existing network for data transmission to the Gaming System 130, computer or recording equipment. In general, it is within the spirit of the invention to be compatible with all gaming systems, computers, plug-and-play karaoke machines, and audio equipment. As such, it is considered that many versions of the Base Station 120 may be sold to enable the Voice Activated Music Controller with Integrated Sound Effect Controls 101 to interact with a variety of downstream devices.

Additionally, it should be noted that in some embodiments the Voice Activated Music Controller with Integrated Sound Effect Controls 101 may send data directly to the Gaming System 130 without the need for a Base Station 120. Many Gaming Systems 130 are enabled to receive wireless data transmission. In situations where the Gaming System 130 may receive information from the Voice Activated Music Controller with Integrated Sound Effect Controls 101 directly, the Base Station 120 may be omitted.

The Gaming System 130 may take the data provided by the Base Station 120, or by the Voice Activated Music Controller with Integrated Sound Effect Controls 101 directly, and may update game play. This may include recording the performance for later playback as well as scoring the performance by pitch and effect adhesion to the displayed cues. Note that the Voice Activated Music Controller with Integrated Sound Effect Controls 101 is designed to function with a wide range or singing and musical games. For example, beyond simple karaoke style games, additional virtual instruments may be included in the game played, and the score generated may reflect the performance of all the input instruments as well as the Voice Activated Music Controller with Integrated Sound Effect Controls 101.

The audio signal received by the Voice Activated Music Controller with Integrated Sound Effect Controls 101 may then be processed for audio effects according to the input on controls by the Player 150. For example, in some embodiments, the audio signal may be processed for audio effects in the Voice Activated Music Controller 101; however, due to the high processing and power consumption demands, this may be unfavorable as compared to downstream processing. Likewise, the audio signal may be processed for the sound effects in the Base Station 120. The benefit of processing at the base station includes reduced processing demands at the Game system 130, and alleviation of power demands on the Voice Activated Music Controller 101. However, it is also considered that processing of the audio signal for sound effects may occur at the Game System 130. As with elsewhere in this disclosure, Game System 130 is intended to refer to all downstream recipients of the audio data including computer systems, recording devices and all game consoles.

It should also be noted that processing of audio signals for the sound effects may be performed by entirely hardware, entirely software, or some combination of the two. In particular, when sound effect processing is occurring at the Gaming System 130, it is unlikely that specialized hardware is available for the sound effect processing. Thus, the Gaming System 130 may include software that emulates the audio effects produced by an effect processor. Such emulative software may be stored on the game medium, be it CDROM, DVD or downloaded.

The Gaming System 130 may provide visual and audio output to the Display 140 and speakers (not shown) indicating scoring and performance cues. An exemplary screenshot from the Display 140 is provided at FIG. 9 and will be discussed in depth below. The Player 150 may take cues from the Display 140, or by audio cues provided by the speakers, and may alter her performance accordingly.

While much of the discussion contained herein is directed toward gaming, the Voice Activated Music Controller 101 is designed for use in a wide range of applications. For example, the Voice Activated Music Controller 101 may be of particular use during professional audio recording or live performance. Likewise, the Voice Activated Music Controller 101 may a powerful tool in the education and training of singers. Moreover, the Voice Activated Music Controller 101 may have use in aiding disabled individuals to communicate and may be of use for speech therapists.

Figure 2A:
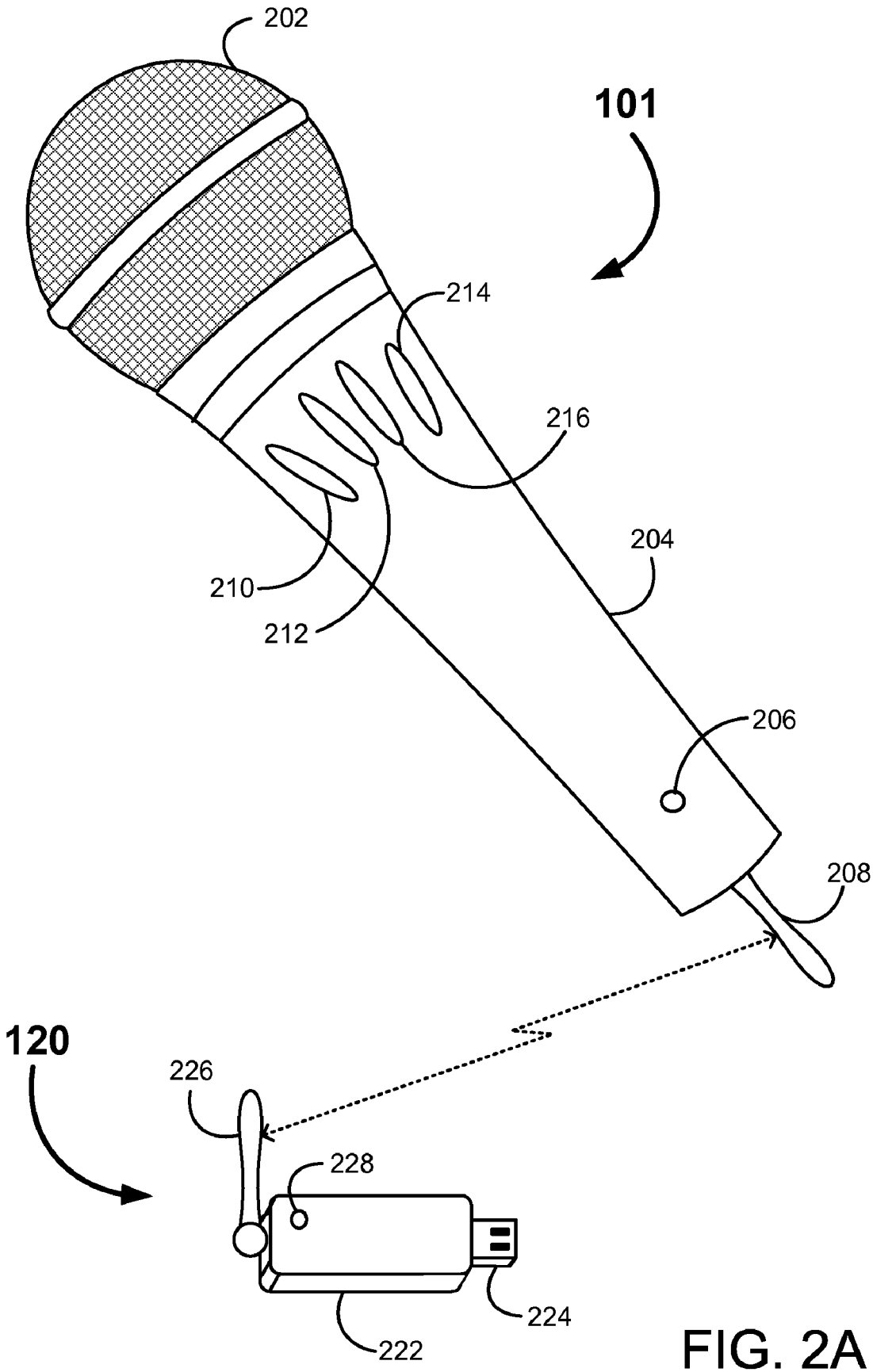
FIG. 2A illustrates an embodiment of the voice activated music controller with integrated controls for audio effects and a base station in accordance with an embodiment of the present invention.

FIG. 2A illustrates the Voice Activated Music Controller with Integrated Sound Effect Controls 101 and Base Station 120 in more detail. Visually, the Voice Activated Music Controller with Integrated Sound Effect Controls 101 may be very similar to current microphones. A Wind Break Mesh 202 covers the Voice Activated Music Controller and reduces wind or airflow pickup by the microphone. The Voice Activated Music Controller Stalk 204 provides a grip for the Player 150 as well as houses the internal circuitry.

Voice Activated Music Controller Inputs A to M 210, 212, 214 and 216 provides the user the ability to input sound effects and audio conditioning. Voice Activated Music Controller Inputs A to M 210, 212, 214 and 216 may include simple buttons or may include touch pads, variable input buttons which detect relative amounts of pressure, track balls, joysticks, or slide switches. As previously noted, these controls may change volume, provide pitch modulation, pitch correction, chorus, voice "echo" effects, addition of sound bites, or any other sound conditioning or effect.

In addition to these external controls, the Voice Activated Music Controller with Integrated Sound Effect Controls 101 may include one or more accelerometers to indicate position and movement of the Voice Activated Music Controller with Integrated Sound Effect Controls 101. In some embodiments, tempo may be controlled through movement of the Voice Activated Music Controller with Integrated Sound Effect Controls 101. Also, in some embodiments, movement of the Voice Activated Music Controller with Integrated Sound Effect Controls 101 may add sound effects such as the sound of a tambourine or triangle. Likewise, particular orientations of the Voice Activated Music Controller with Integrated Sound Effect Controls 101 may engage other sound effects or modulations to the audio input. For example, when in a climatic portion of a song, a Player 150 may tip the Voice Activated Music Controller 101 up such that it is inverse the normal orientation. This movement in conjunction with a sustained pitch of elevated amplitude may indicate a reverberation effect for an enhanced performance.

An Indicator Light 206 may provide indication when the Voice Activated Music Controller with Integrated Sound Effect Controls 101 is "on". Since the Voice Activated Music Controller with Integrated Sound Effect Controls 101 is wireless, an internal power supply, such as battery power, is required for operation. Thus, there is a need to conserve power whenever possible. As such, in some embodiments, the Voice Activated Music Controller with Integrated Sound Effect Controls 101 may enter a "sleep" or "hibernate" like mode when inactivity is measured for a set amount of time. Inactivity may be measured by accelerometer motion detection or by lack of audio signals above ambient levels. Inversely, motion of the Voice Activated Music Controller with Integrated Sound Effect Controls 101 may cause the Voice Activated Music Controller with Integrated Sound Effect Controls 101 to turn "on". In some embodiments, the Voice Activated Music Controller with Integrated Sound Effect Controls 101 may also include a "power" switch for turning the Voice Activated Music Controller with Integrated Sound Effect Controls 101 on and off.

Extending from the bottom of the Voice Activated Music Controller Stalk 204 is an Antenna 208. In some embodiments, the Antenna 208 may be concealed within the Voice Activated Music Controller Stalk 204. The Antenna 208 may transmit audio and control data to the Antenna 226 of the Base Station 120. The transmission may be radio frequency, or may include infra red or other wavelength of transmission. In some embodiments, the transmission signal may be at 24 bit per second; however, faster or slower data transmission may be utilized. Audio and control signals may be interleaved, utilize variations in frequency or utilize headers in order to differentiate transmitted signals.

The Base Station 120 may include a Receiver Housing 222 with an Indicator Light 228. Also on the Receiver Housing 222 may be a series of controls (not shown) for configuring the Base Station 120 and for synchronizing the particular Base Station 120 to a particular Voice Activated Music Controller with Integrated Sound Effect Controls 101. In such a way, multiple Voice Activated Music Controllers with Integrated Sound Effect Controls 101 may be used in a game, and each Base Station 120 will selectively filter the received data signals for those originating from the Voice Activated Music Controller with Integrated Sound Effect Controls 101 that it has been synchronized to.

A Universal Serial Bus (USB) Connector 224 may extend from the Base Station 120 for coupling to the Gaming System 130. Again the illustrated USB Connector 224 is intended as an example and additional connector types may be utilized dependent upon Gaming System 130 input capability.

Figure 2B:
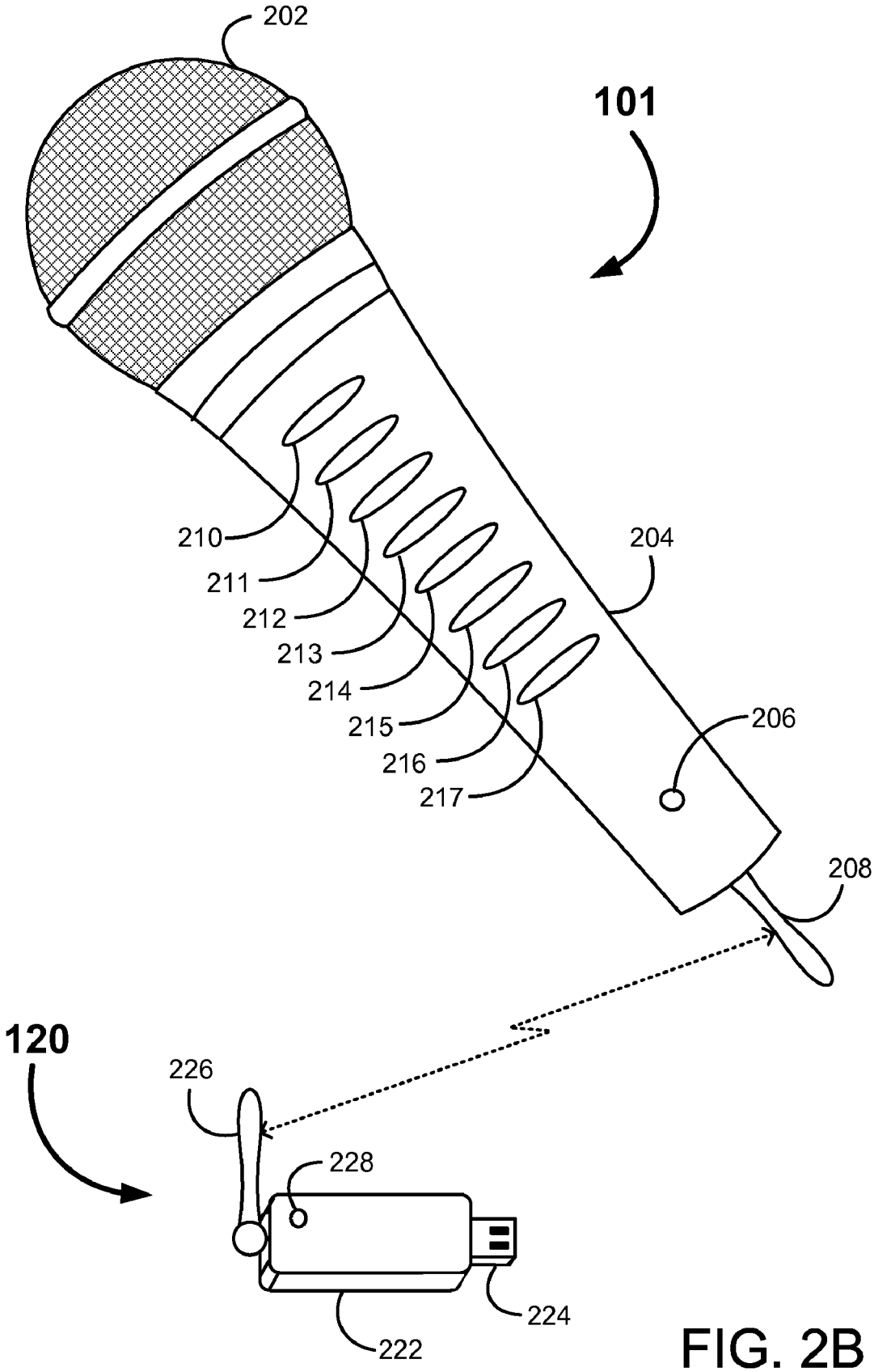
FIG. 2B illustrates another embodiment of the voice activated music controller with integrated controls for audio effects and a base station in accordance with an embodiment of the present invention.

FIG. 2B illustrates another embodiment of the Voice Activated Music Controller 101 with integrated controls for audio effects and Base Station 120. Like the embodiment illustrated at FIG. 2A, a Wind Break Mesh 202 covers the microphone and reduces wind or airflow pickup by the microphone. The Voice Activated Music Controller Stalk 204 provides a grip for the Player 150 as well as houses the internal circuitry.

The major difference between this embodiment and the previous embodiment of the Voice Activated Music Controller 101 is the number and orientation of the Voice Activated Music Controller Inputs 210, 211, 212, 213, 214, 215, 216 and 217. These inputs provide the user the ability to input sound effects and audio conditioning. The orientation of the inputs likewise enables the Player 150 to hold the Voice Activated Music Controller 101 in an orientation similar to a flute or clarinet. As noted, Voice Activated Music Controller Inputs 210, 211, 212, 213, 214, 215, 216 and 217 may include simple buttons or may include touch pads, variable input buttons which detect relative amounts of pressure, track balls, or slide switches. As previously noted, these controls may change volume, provide pitch modulation, pitch correction, chorus, voice "echo" effects, addition of sound bites, or any other sound conditioning or effect.

As with the previous embodiment, in addition to these external controls, the Voice Activated Music Controller with Integrated Sound Effect Controls 101 may include one or more accelerometers to indicate position and movement of the Voice Activated Music Controller 101. Also, an Indicator Light 206 may provide indication when the Voice Activated Music Controller with Integrated Sound Effect Controls 101 is "on".

The orientation of the inputs on this embodiment of the Voice Activated Music Controller 101 facilitates its use as an instrument. For example, the Voice Activated Music Controller 101 may be used to emulate a clarinet. The Player 150 may sing or hum into the Voice Activated Music Controller 101 while manipulating the inputs. The Voice Activated Music Controller 101 may then transfer these signals from the user into instrumental effects. Such instrumental effects may be applied in the same fashion as other sound effects described herein.

In yet other embodiments, the audio pickup for the Voice Activated Music Controller 101 may be turned off in order to use the Voice Activated Music Controller 101 as a controller unit.

Extending from the bottom of the Voice Activated Music Controller Stalk 204 is an Antenna 208. In some embodiments, the Antenna 208 may be concealed within the Voice Activated Music Controller Stalk 204. The Antenna 208 may transmit audio and control data to the Antenna 226 of the Base Station 120. The Base Station 120 of this embodiment may resemble the Base Station 120 of the previous exemplary embodiment.

Figure 2C:
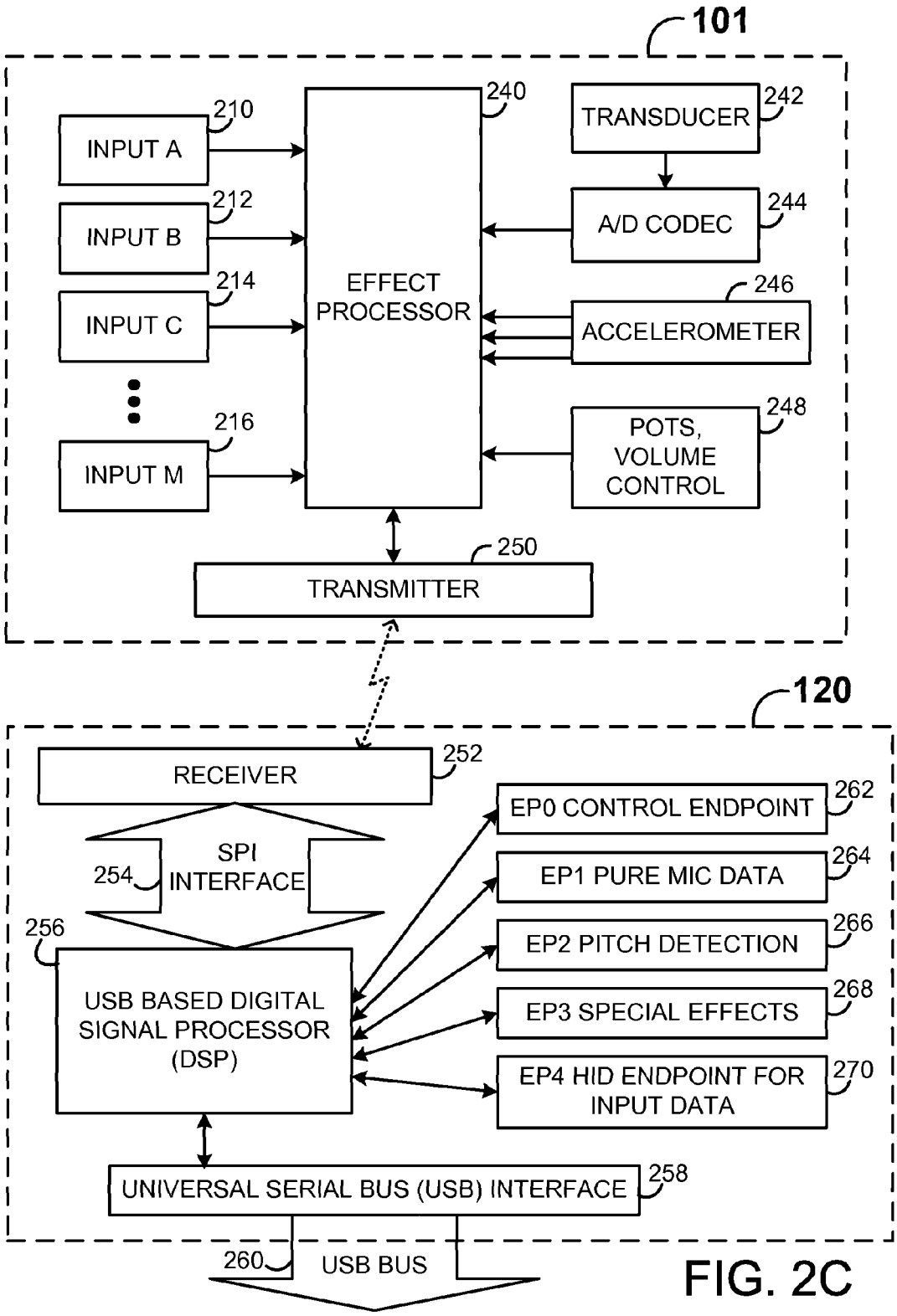
FIG. 2C illustrates a functional block diagram of the voice activated music controller with integrated controls for audio effects and base station in accordance with an embodiment of the present invention.

FIG. 2C illustrates functional block diagrams of the Voice Activated Music Controller with Integrated Sound Effect Controls 101 and Base Station 120. The Voice Activated Music Controller 101 may include a Transducer 242 configured to receive audio signals. The Transducer 242 may include a standard magnet and membrane microphone, a piezo microphone, or any other audio pickup mechanism. Signals from the Transducer 242 may be sent to an A/D CODEC 244 which may convert the analog signal and convert it into a digital signal. The digitized audio feed may then be sent to an Effect Processor 240.

Likewise, one or more Accelerometers 246 may be configured to detect motion of the Voice Activated Music Controller 101. In some embodiments, three Accelerometers 246 may be included in the Voice Activated Music Controller 101. These Accelerometers 246 may be positioned as to be able to detect movement along each of the X axis, Y axis and Z axis respectively. Output data from the Accelerometer(s) 246 may be sent to the Effect Processor 240.

A Potentiometer for Volume Control 248 may likewise be seen providing volume data selected by the Player 150 to the Effect Processor 240. Various Inputs A to M 210, 212, 214 and 216 may likewise be manipulated by the Player 150 and provide data to the Effect Processor 240.

Processed signals are sent from the Effect Processor 240 to a Transmitter 250 for transmission to the Receiver 252 of the Base Station 120. In some embodiments the Receiver 252 may additionally include a transceiver capability. The Receiver 252 may communicate with the UBS Based Digital Signal Processor (DSP) 256 via a SPI Interface 254.

The USB Based DSP 256 may perform several operations. In some embodiments the USB Based DSP 256 may utilize USB version 2.0 spec. The USB Based DSP 256 may control mode of the devices, shown at Endpoint 0 262. The ability to control mode enables transparency of the receiver with traditional microphones.

A 16 bit Pulse-Code Modulation (PCM) decoder may be included in the USB Based DSP 256. The PCM decoder may determine pure microphone data including word and octave information at Endpoint 1 264. Likewise, the PCM decoder may be configured to perform pitch detection at Endpoint 2 266. Although not shown, the USB Based DSP 256 may additionally be enabled to generate note data from the received audio signal. This note data may be captured as a MIDI format for downstream application. Particularly, such MIDI note information, which includes frequency (note) and amplitude (velocity) data, may be used to drive instrumental effects. As noted in FIG. 2B, the Voice Activated Music Controller 101 may be used as an instrument emulator. By singing into the device, the frequency and amplitude of the audio signal may be synthesized into any range of musical instrumentation. This may be of particular use in a band, game or recording environment.

The USB Based DSP 256 may include processing for special effects at Endpoint 3 268. As previously mentioned, these effects may include chorus effects, flanger, pitch modulation, reverberation, sound bite inclusion, hollow effects, or any additional effects desired. Additionally, the USB Based DSP 256 may include access to a Human Interface Device (HID) to enable configuration of inputs to particular effects at Endpoint 4 270.

Processed signals may be then output by the USB Based DSP 256 to a Universal Serial Bus (USB) Interface 258. Thus, data may be provided to the Gaming System 130 via the USB Bus 260.

Figure 3:
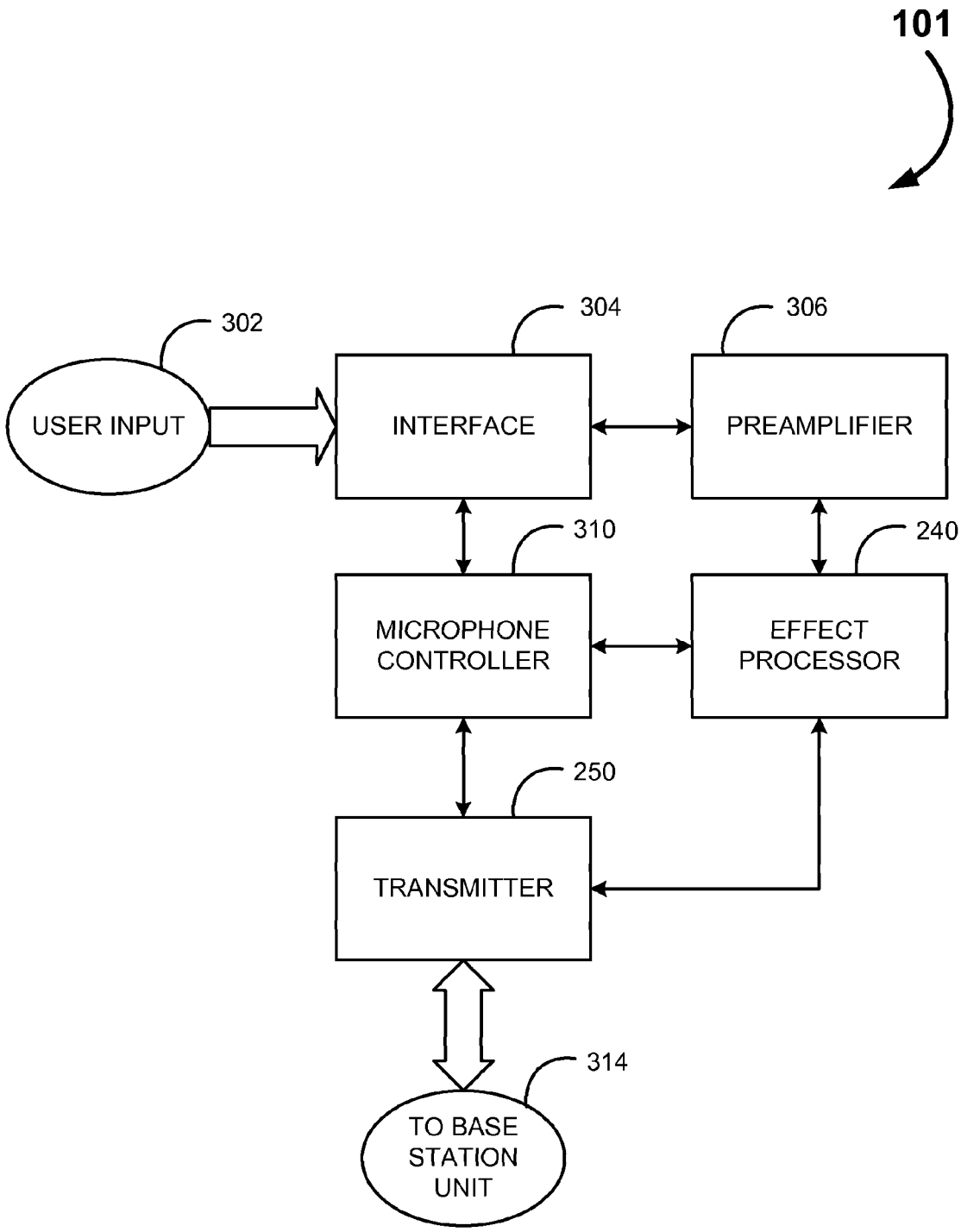
FIG. 3 illustrates a functional block diagram of the voice activated music controller with integrated controls for audio effects in accordance with an embodiment of the present invention.

FIG. 3 illustrates a functional block diagram of an embodiment of the Voice Activated Music Controller with Integrated Sound Effect Controls 101. User Input 302 is provided to the Interface 304 of the Voice Activated Music Controller with Integrated Sound Effect Controls 101. As previously noted, User Input 302 includes audio data, as well as control manipulation data. The signal then gets amplified by the Preamplifier 306. In some embodiments, the Preamplifier 306 additionally is an Analog to Digital Converter (ADC). Additional information collected by the Interface 304 may be sent to the Microphone Controller 310. The signal may then be processed by an Effect Processor 240, which may apply the effects indicated by the User Input 302. In some alternate embodiments, the Effect Processor 240 may be omitted, and the Gaming System 130 may include software that emulates the audio effects produced by the Effect Processor 240. Such emulative software may be stored on the game medium, be it CDROM, DVD or downloaded. Likewise, in yet other embodiments, the processing of the audio signals for effects may occur in the Base Station 120. Particularly, the USB Based DSP 256 may perform sound effect processes.

Then the signal is sent to the Transmitter 250 for transmission to the Base Station at 314. As noted above, transmission may include Radio Frequency (RF) transmission, or other wavelength of transmission signal.

Figure 4:
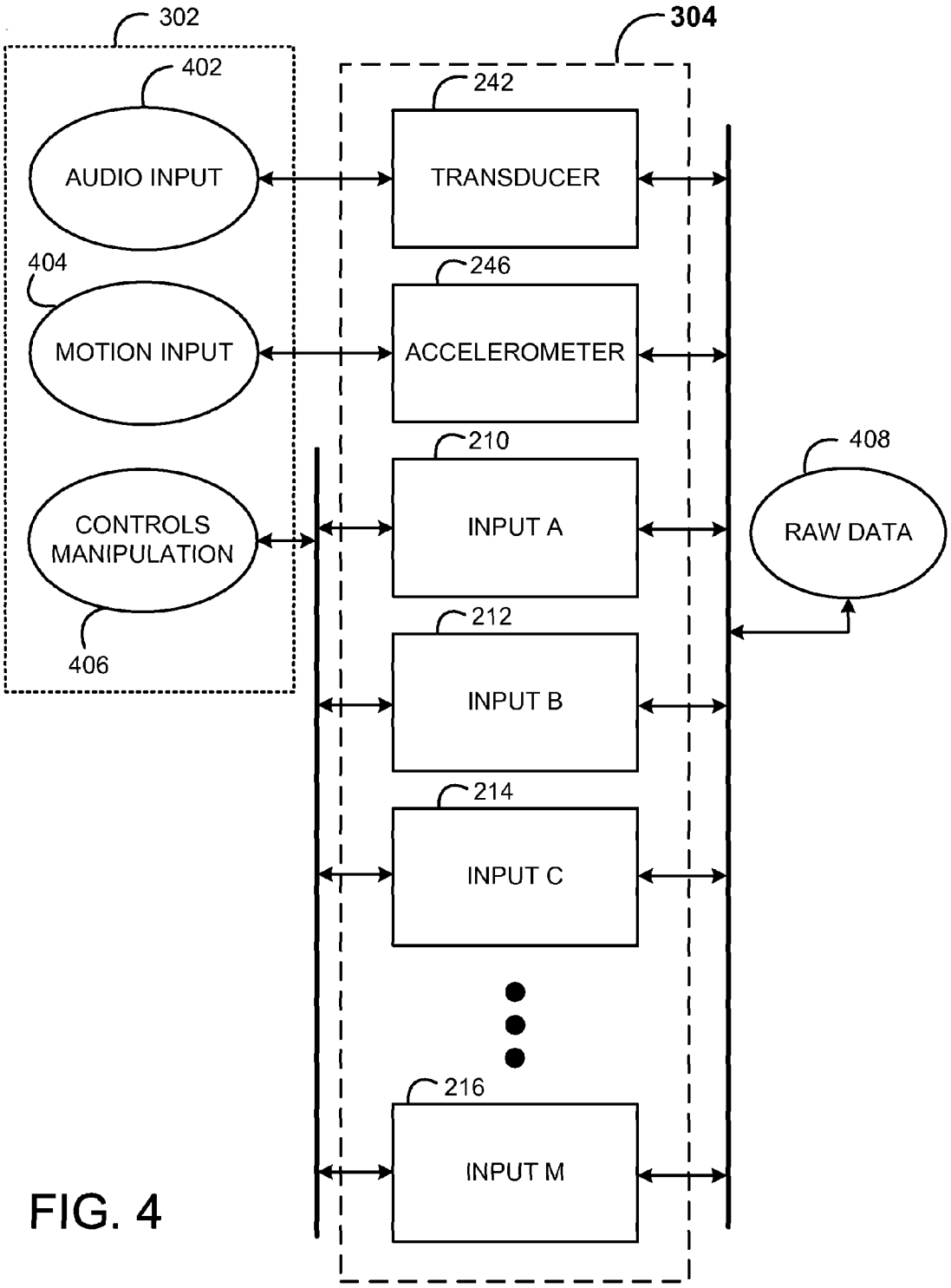
FIG. 4 illustrates a functional block diagram of the player interface for the voice activated music controller with integrated controls for audio effects in accordance with an embodiment of the present invention.

FIG. 4 illustrates a functional block diagram of the player Interface 304 for the Voice Activated Music Controller with Integrated Sound Effect Controls 101. The Interface 304 may include, but is not limited to a Transducer 242, an Accelerometer 246, and Inputs A to M 210, 212, 214 and 216. Likewise, the User Input 302 may include any combination of Audio Input 402, Motion Input 404 and Control Manipulations 406. The Transducer 242 is configured to collect the Audio Input 402 information. The Accelerometer 246 collects the Motion Input 404. The Control Manipulations 406 may be performed upon any of the Input A 210, Input B 212, Input C 214 and Input M 216. All collected signals may then be converted into Raw Data 408.

Figure 5:
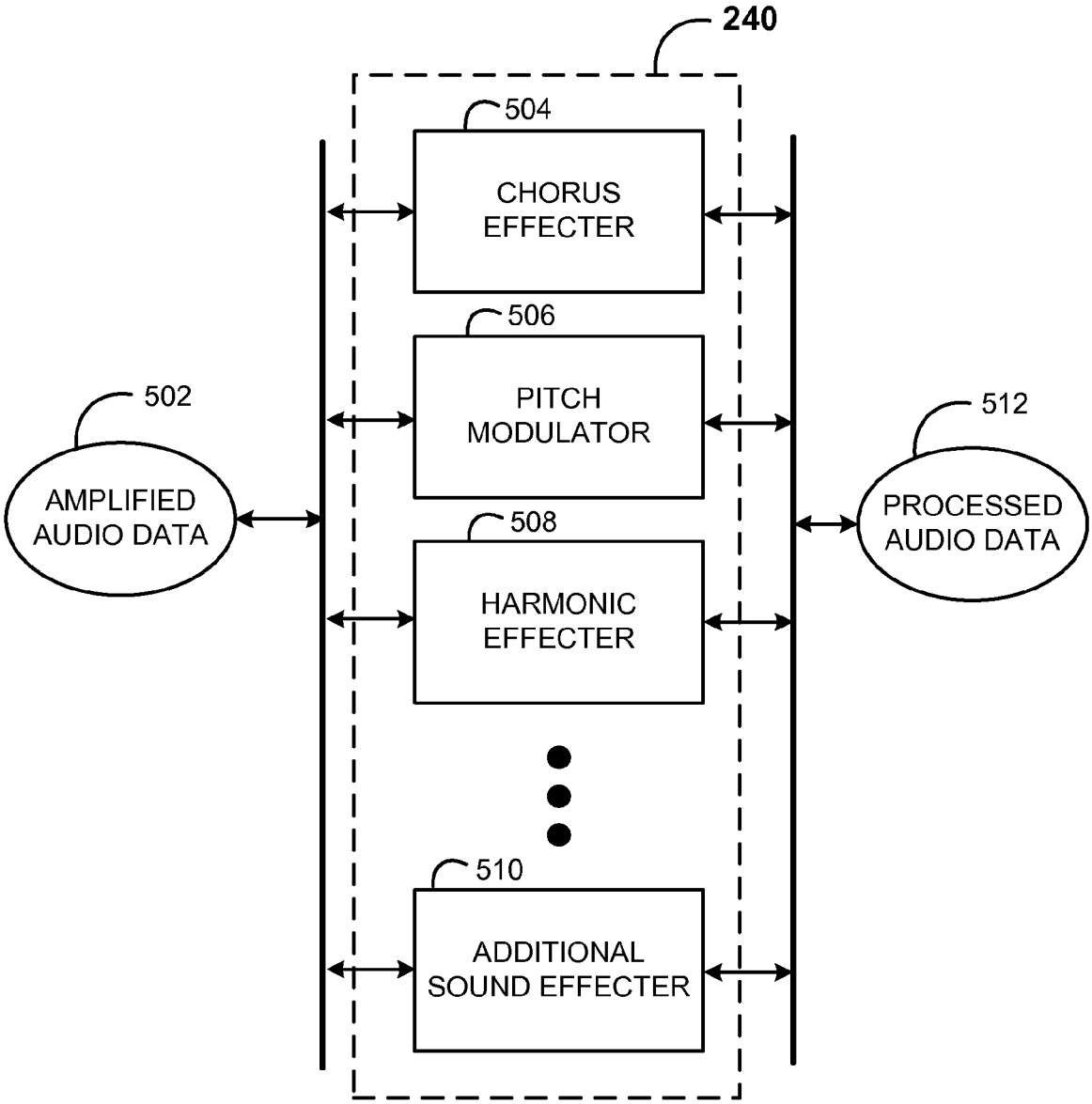
FIG. 5 illustrates a functional block diagram of the effects processor for voice activated music controller with integrated controls for audio effects in accordance with an embodiment of the present invention.

FIG. 5 illustrates a functional block diagram of the Effect Processor 240 for the Voice Activated Music Controller with Integrated Sound Effect Controls 101. The Amplified Audio Data 502 is received by the Effect Processor 240 from the Preamplifier 306. Within the Effect Processor 240 may be any of, but not limited to, a Chorus Effecter 504, a Pitch Modulator 506 a Harmonic Effecter 508 and one or more Additional Sound Effecters 510. The Additional Sound Effecters 510 may include reverberation effects, echo effects, pitch correction, sound bites or any additional desired effect. The control manipulation by the Player 150 dictates which effecter will process the Amplified Audio Data 502. The resulting Processed Audio Data 512 may then be output to the Transmitter 250.

As previously mentioned, the Effect Processor 240 may be omitted in some embodiments when the Gaming System 130 includes emulation software.

Figure 6:
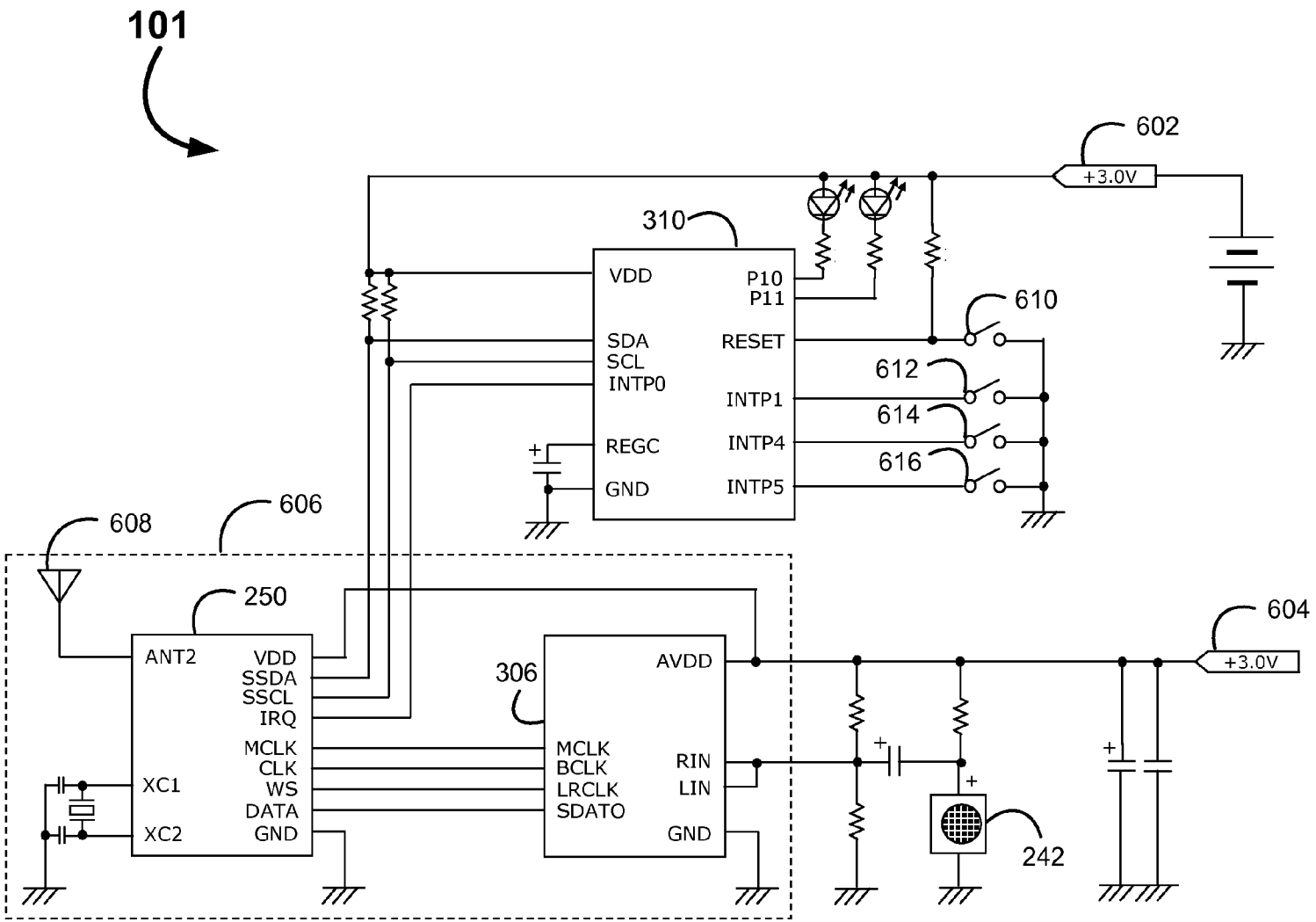
FIG. 6 illustrates a top level circuit diagram of the voice activated music controller with integrated controls for audio effects in accordance with an embodiment of the present invention.

FIG. 6 illustrates a top level circuit diagram of the Voice Activated Music Controller with Integrated Sound Effect Controls 101. A Transducer 242 inputs audio information to the Preamplifier 306. The Preamplifier 306 may, in some embodiments, be a Wolfson™ 24 Bit stereo ADC Model number WM8738, or equivalent. The WM8738 provides stereo line-level audio inputs, along with a control input pin to enable operation of the audio interface in either one of two industry standard modes. The WM8738 also has a selectable digital high pass filter to remove residual DC offsets. Stereo 24-bit multi-bit sigma delta ADCs are provided by the WM8738, along with oversampling digital interpolation filters. The WM8738 supports 24-bit digital audio output word lengths and sampling rates from 8 kHz to 96 kHz.

A 3 Volt power Source 604 provides power to the Preamplifier 306 and Transmitter 250. The Preamplifier 306 additionally couples to the Transmitter 250. The Transmitter 250 couples to an RF Antenna 608. The Preamplifier 306, Transmitter 250 and RF Antenna 608 all compose the Functional Transmission Unit 606. The Transmitter 250 may, in some embodiments, be the Nordic™ 2.4 GHz wireless audio streamer chip model number nRF24Z1 or equivalent. The nRF24Z1 enables up to 16-bit, 48 kHz audio streaming without using compression, and also features input support of up to 24-bit, 48 kHz. In addition to streaming audio up to 4 Mbit/s, the nRF24Z1 also enables a digital control information channel for transfer of control information such as volume, balance and display details. Using industry standard 12S and S/PDIF interfaces for audio, the nRF24Z1 may interface without glue logic to most digital audio sources, or external industry standard low cost A/D and D/A converters for analog audio input and output. Control information uses SPI or 2-wire (I2C compatible).

The Microphone Controller 310 may couple to the Transmitter 250. The Microphone Controller 310 may, in some embodiments, be the NEC™ 8-bit microcontroller model number μPD78F0500. The μPD78F0500 includes an 8-bit 78K0 Central Processing Unit (CPU) core with a 20 MHz clock frequency. Additionally, the μPD78F0500 may include two on-chip oscillators plus optional external oscillators. The μPD78F0500 includes multimaster capable $I^2C$ interface, four 8-bit timers, one 16-bit timer, and one 3-wire serial interface (SPI). Power is supplied to the Microphone Controller 310 via the 3 Volt power Source 602.

A Reset Switch 610 couples to the Microphone Controller 310. Likewise, a Link Switch 612, a Volume-Up Switch 614 and a Volume-Down Switch 616 each couple to the Microphone Controller 310.

Figure 7A:
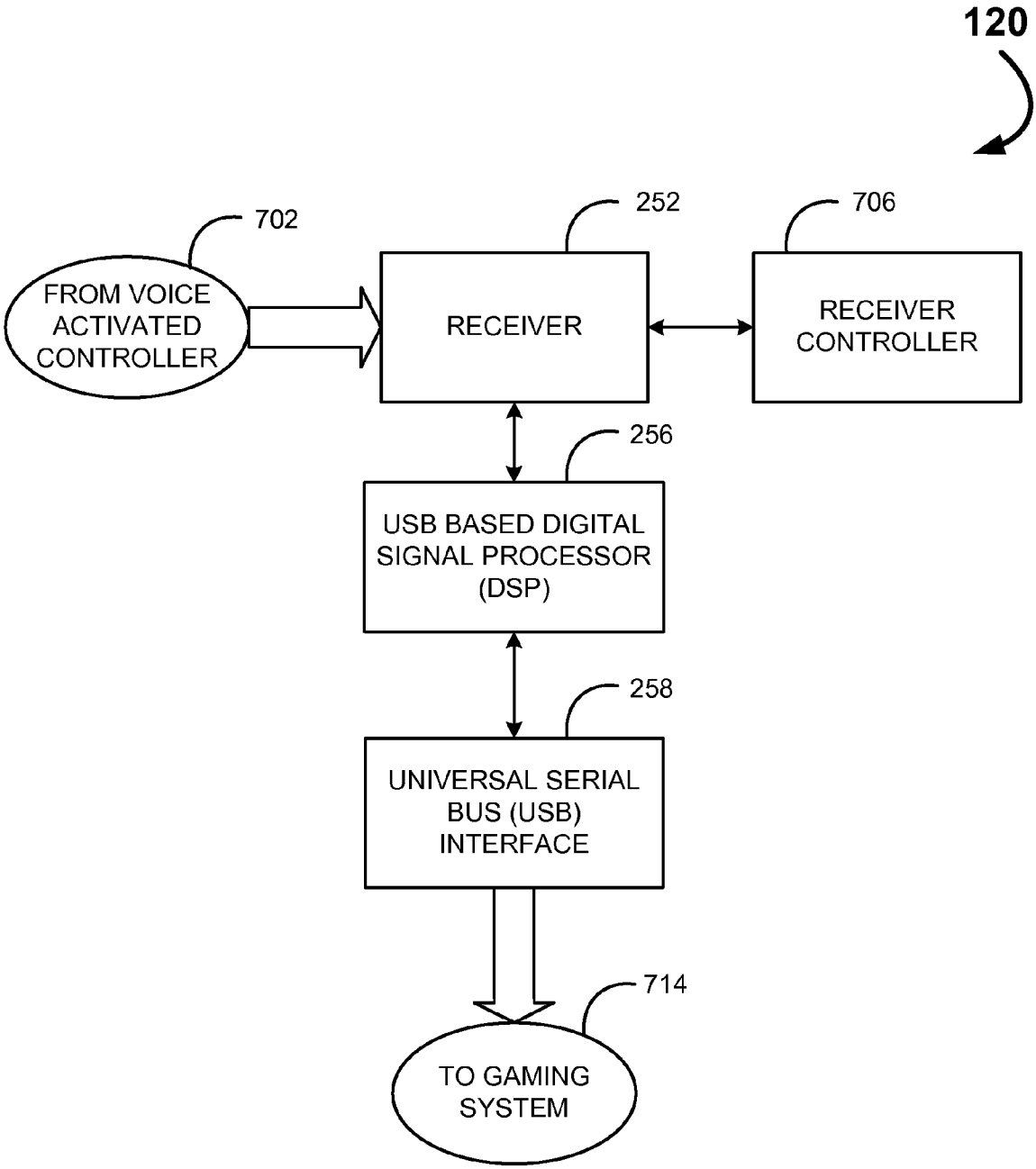
FIG. 7A illustrates one embodiment of a functional block diagram of the voice activated music controller base station in accordance with an embodiment of the present invention.

FIG. 7A illustrates a first embodiment of a functional block diagram of the Base Station 120. Data from the Voice Activated Music Controller with Integrated Sound Effect Controls 101, shown at 702, are received by the Receiver 252. In some embodiments, the Receiver 252 may be a transceiver. The Receiver Controller 706 controls the Receiver 252. A USB Based DSP 256 converts the received signal into a data signal appropriate for consumption by the Gaming System 130. In some embodiments, the USB Based DSP 256 performs the desired sound effects upon the raw audio signal as well as performing pitch and octave detection. The signal is then provided to the Universal Serial Bus (USB) Interface 258 which then sends the data to the Gaming System 130 at 714.

Figure 7B:
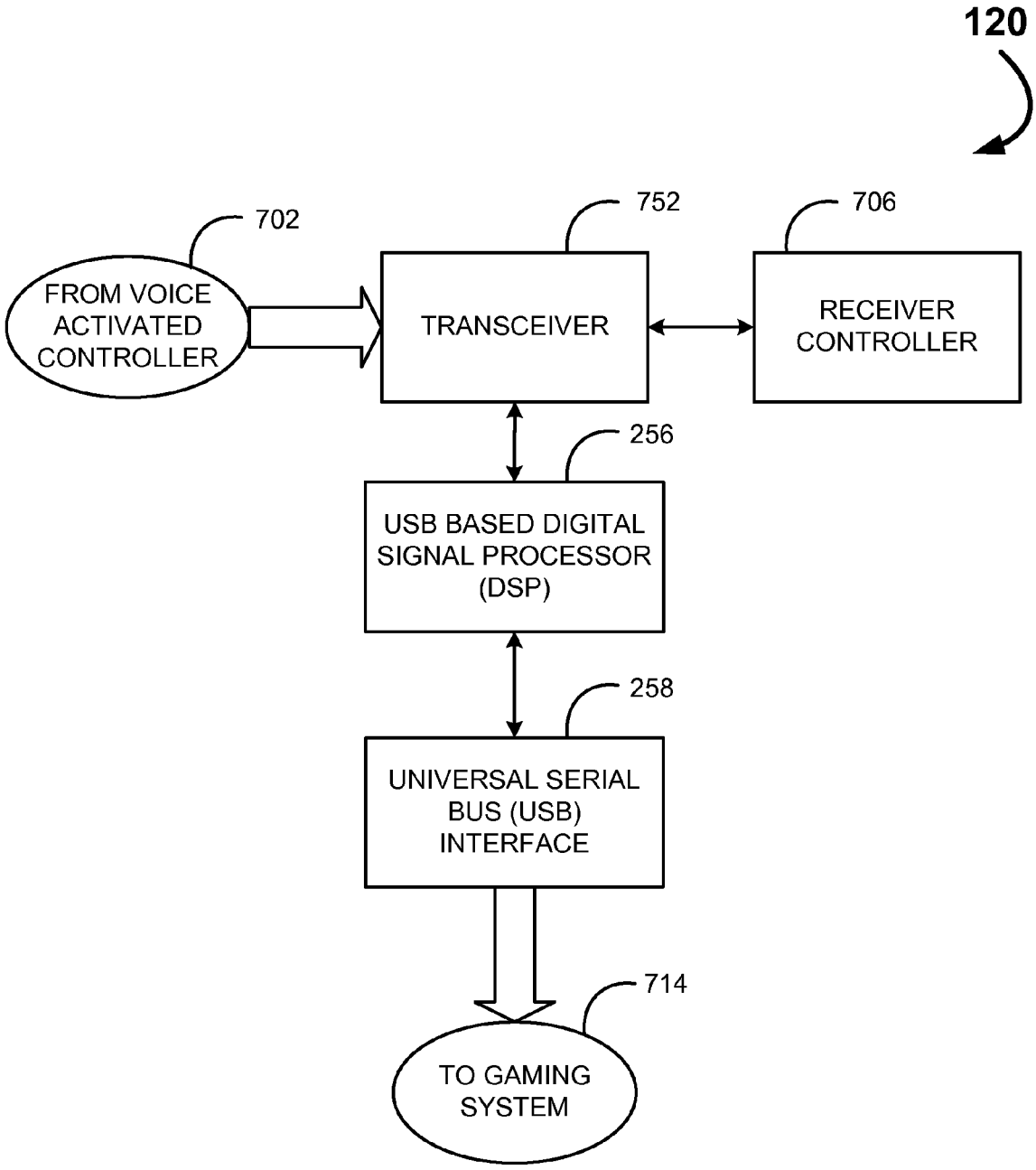
FIG. 7B illustrates another embodiment of a functional block diagram of the voice activated music controller base station in accordance with an embodiment of the present invention.

FIG. 7B illustrates another embodiment of a functional block diagram of the Base Station 120. Data from the Voice Activated Music Controller with Integrated Sound Effect Controls 101, shown at 702, are received by the Transceiver 752. The Receiver Controller 706 controls the Transceiver 752. A transceiver enables two way communication between the Base Station 120 and the Voice Activated Music Controller 101.

Again, a USB Based DSP 256 converts the received signal into a data signal appropriate for consumption by the Gaming System 130. In some embodiments, the USB Based DSP 256 performs the desired sound effects upon the raw audio signal as well as performing pitch and octave detection. The signal is then provided to the Universal Serial Bus (USB) Interface 258 which then sends the data to the Gaming System 130 at 714.

Figure 8:
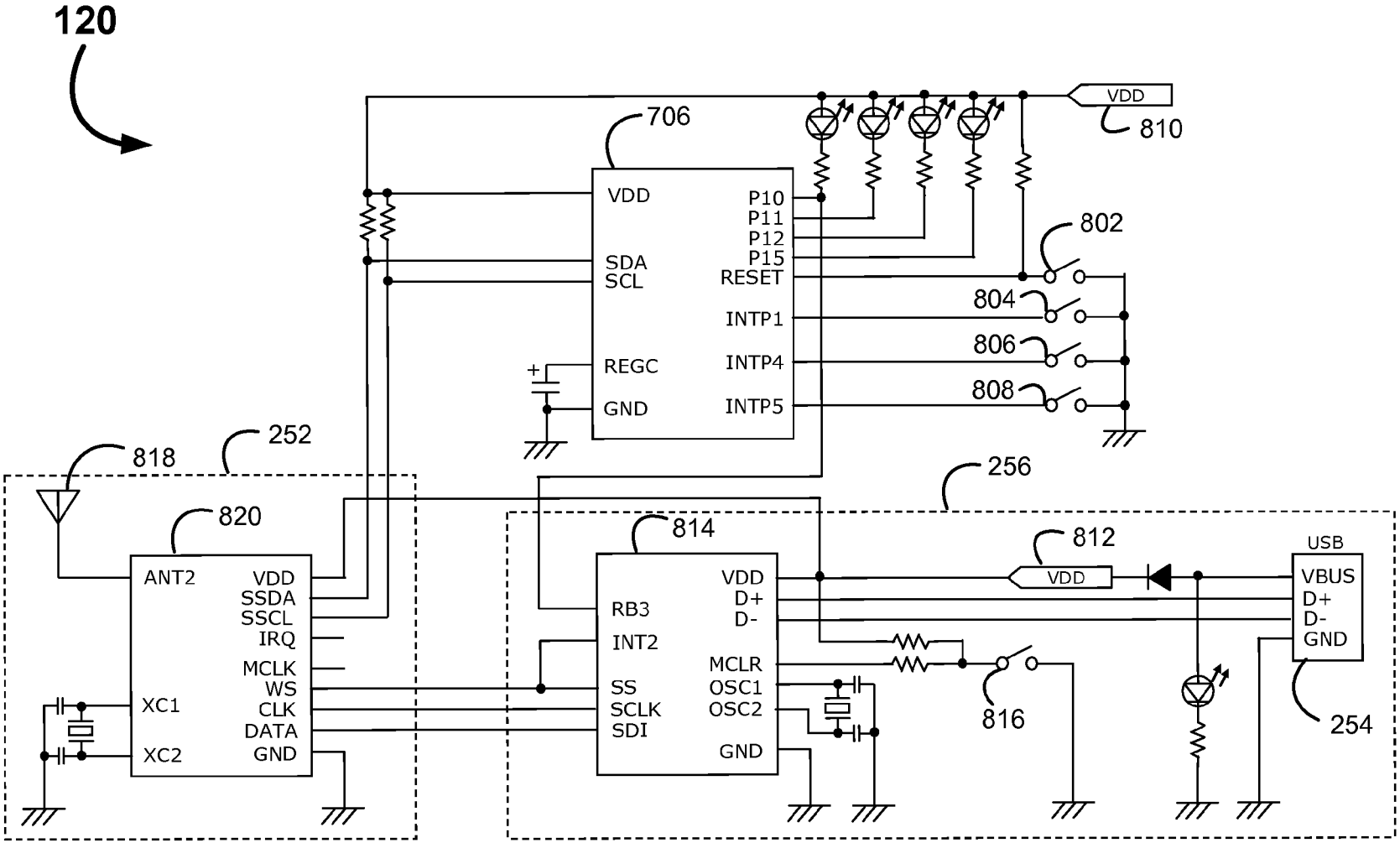
FIG. 8 illustrates a top level circuit diagram of the voice activated music controller base station in accordance with an embodiment of the present invention.

FIG. 8 illustrates a top level circuit diagram of the Base Station 120. Here an RF Antenna 818 receives the RF signal from the Transmitter 250 of the Voice Activated Music Controller with Integrated Sound Effect Controls 101. The data then progresses to the Receiver Chip 820. The Receiver Chip 820 and RF Antenna 818 comprise the Receiver 252.

The Receiver Chip 820 may, in some embodiments, be the Nordic™ 2.4 GHz wireless audio streamer chip model number nRF24Z1 or equivalent. As previously noted, the nRF24Z1 enables up to 16-bit, 48 kHz audio streaming without using compression, and also features input support of up to 24-bit, 48 kHz. In addition to streaming audio up to 4 Mbit/s, the nRF24Z1 also enables a digital control information channel for transfer of control information such as volume, balance and display details. Using industry standard 12S and S/PDIF interfaces for audio, the nRF24Z1 may interface without glue logic to most digital audio sources, or external industry standard low cost A/D and D/A converters for analog audio input and output. Control information uses SPI or 2-wire (I2C compatible).

A Receiver Controller 706 couples to the Receiver Chip 820. Like in the circuit of the Voice Activated Music Controller with Integrated Sound Effect Controls 101, the Receiver Controller 706 may be a NEC™ 8-bit microcontroller model number μPD78F0500. As previously discussed, the μPD78F0500 includes an 8-bit 78K0 Central Processing Unit (CPU) core with a 20 MHz clock frequency. Additionally, the μPD78F0500 may include two on-chip oscillators plus optional external oscillators. The μPD78F0500 includes multimaster capable $I^2C$ interface, four 8-bit timers, one 16-bit timer, and one 3-wire serial interface (SPI). Power may be supplied to the Receiver Controller 706 via the 3 Volt Power Supply 810. A Reset Switch 802, Link Switch 804, a Volume-Up Switch 806 and a Volume-Down Switch 808 each couple to the Receiver Controller 706. Additionally, the Receiver Controller 706 couples to the USB Based DSP 256.

The USB Based DSP 256 may, in some embodiments, be a Microchip™ USB Microcontroller model number 18F4550. The 18F4550 is USB V2.0 compliant, and supports control, interrupt, isochronous and bulk transfers. The 18F4550 includes 1-Kbyte dual access RAM for USB. Moreover, the 18F4550 has an on-chip USB transceiver with on-chip voltage regulator. Further, the 18F4550 includes an interface for off-chip USB transceiver streaming parallel port (SPP) for USB streaming transfers. A Reset Switch 816 couples to the USB Based DSP 256 as well as the Receiver Chip 820. Additionally, the USB Based DSP 256 may couple to a USB Interface 258.

The USB Interface 258, and USB Based DSP 256 may be components on a USB Board 814. The USB Board 814 may, in some embodiments, be a Microchip™ PICDEM™ FS USB Demonstration Board.

Figure 9:
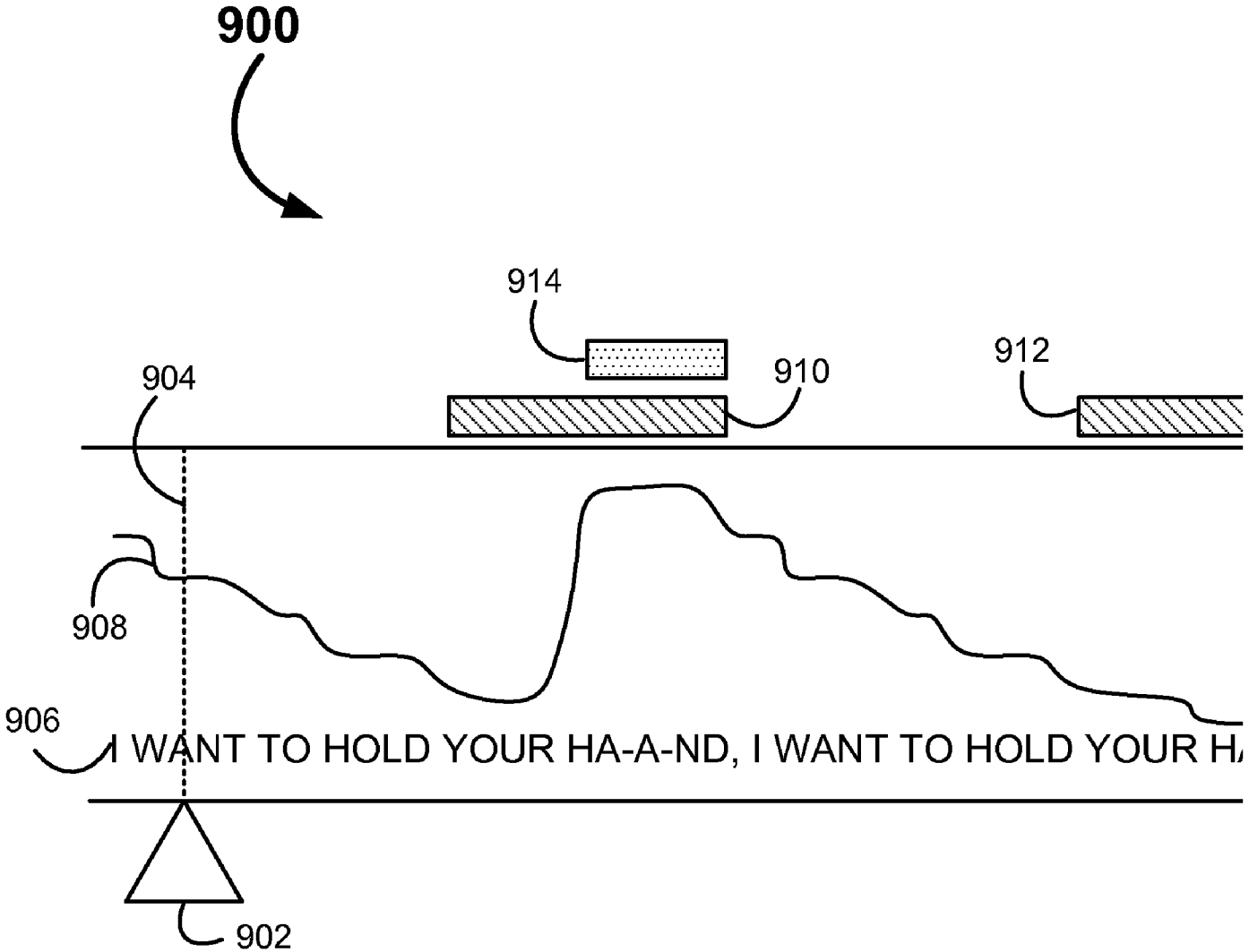
FIG. 9 shows an exemplary illustration of a screenshot from the display for use in a game with the voice activated music controller with integrated controls for audio effects in accordance with an embodiment of the present invention.

FIG. 9 shows an exemplary illustration of a screenshot from the Display 140 for use in a game with the Voice Activated Music Controller with Integrated Sound Effect Controls 101, shown generally at 900. It should be noted that this screenshot is merely an example, and many alterations and permutations to the proposed display are within the spirit of the present invention.

In this exemplary display there is a Timing Pointer 902 and Timing Bar 904 indicating the present time. The remaining portions of the display scroll as a constant rate such the Timing Pointer 902 and Timing Bar 904 remain at a fixed point and the Song Lyrics 906 and Pitch Guide 908 scroll past them. As the Song Lyrics 906 scroll past the Timing Pointer 902 and Timing Bar 904, the Player 150 should sing the words into the Voice Activated Music Controller 101. Likewise, the Pitch Guide 908 indicates to the Player 150 the relative pitch the Song Lyrics 906 should be sung to.

However, in addition to the Song Lyrics 906 and Pitch Guide 908 scrolling across the Display 140 screen, in some embodiments, control indicator bars may additionally be seen scrolling along with the Song Lyrics 906 and Pitch Guide 908. These indicator bars may be color coded to match colored controls on the Voice Activated Music Controller with Integrated Sound Effect Controls 101. In the exemplary illustration, First Control Cue 910, Second Control Cue 912 and Third Control Cue 914 may signify to the Player 150 to depress particular controls on the Voice Activated Music Controller with Integrated Sound Effect Controls 101 in an effort to produce additional effects. For example, the First Control Cue 910 and the Third Control Cue 912 may indicate a chorus effect. Likewise, the Second Control Cue 914 may indicate a rise in pitch for one of the chorus voices. In such a way, complex audio effects may be generated by the individual Player 150 with relative ease.

Figure 10:
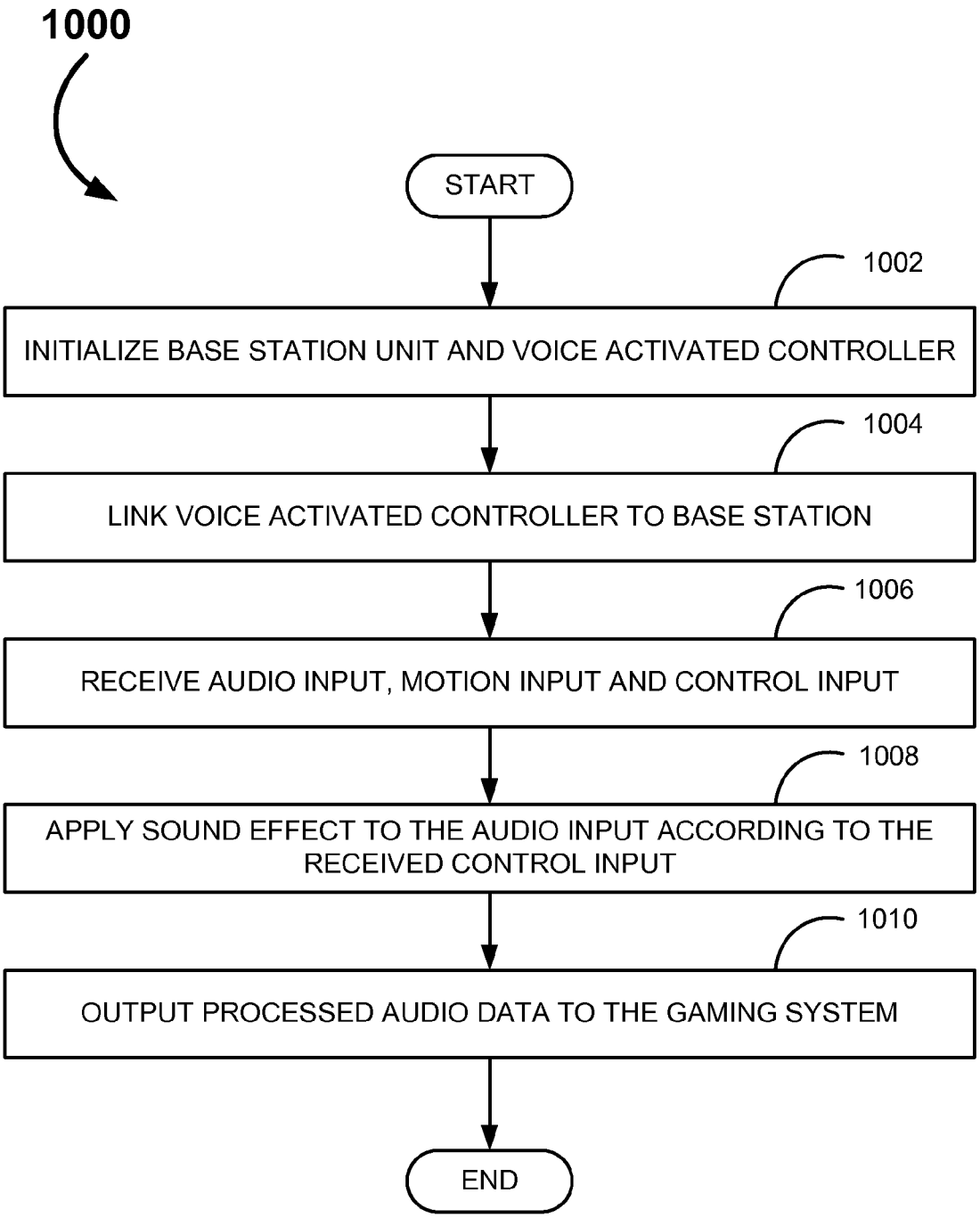
FIG. 10 shows a flowchart illustrating voice activated music controller and receiver operation.

FIG. 10 shows a flowchart illustrating Voice Activated Music Controller and receiver operation, shown generally at 1000. The process begins at step 1002 where the Base Station and Voice Activated Music Controller are initialized. Initialization of the Base Station may occur when the gaming system is booted. Initialization of the Voice Activated Music Controller may be in response to pushing an "on" button on the Voice Activated Music Controller, movement of the Voice Activated Music Controller, or elevated sound waves consistent with someone speaking into the Voice Activated Music Controller.

After the Voice Activated Music Controller and receiver have been initialized, they may link to one another at step 1004. Linking of the Voice Activated Music Controller and Base Station is of particular importance when more than one player has a Voice Activated Music Controller. In these cases, each Base Station may be configured to isolate the transmitted data signal from the particular Voice Activated Music Controller it has been linked to. This reduces "noise" or mixing of signals.

At step 1006 the Voice Activated Music Controller receives audio input, motion input and input from the manipulation of the controls. Audio signals are often amplified by the preamplifier. Additionally, the analog signals may be converted to digital signals at this step. Then, at step 1008, the sound effects indicated by the control manipulations may be applied to the audio signal. This application of sound effects may be performed by the Voice Activated Music Controller. Alternatively, this sound effect processing may be performed at the Base Station after transmission of the original signal from the Voice Activated Music Controller. Lastly, the sound effect processing may be performed at the gaming system using emulation software. Regardless of where the audio signal is processed to include the sound effects, at step 1010 the processed signal is received by the gaming system. The process then ends.

Figure 11:
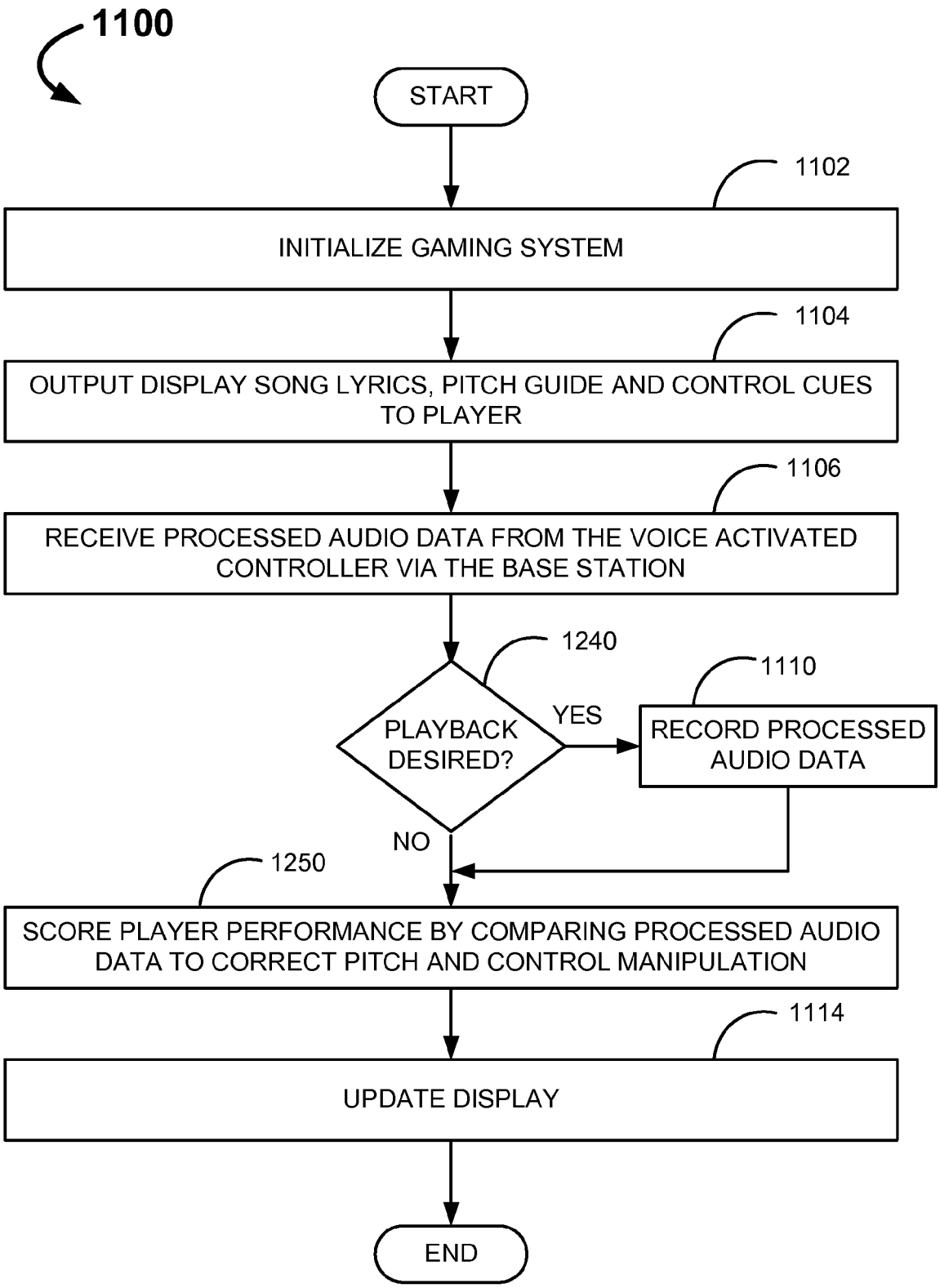
FIG. 11 shows a flowchart illustrating game system operation.

FIG. 11 shows a flowchart illustrating game system operation, shown generally at 1100. The process begins at step 1102 where the gaming system is initialized. Typically, the player presses a power button on the system, or a controller, in order to boot the gaming system. Again, the gaming system is intended to be a generic name for a consol style gaming system, such as Nintendo Wii™, Playstation™, or Xbox 360™. Additionally, gaming system may refer to any computer running game software, a karaoke machine, or any other device which receives audio data from a microphone.

At step 1104, the gaming system may output song lyrics, pitch guides and control cues to the display or via speakers. This display may resemble the exemplary display shown at FIG. 9. The player will respond to the display by singing and entering in commands via the controls. This audio data and control data will be received by the Voice Activated Music Controller in the manner discussed above. The audio signal is processed according to the control manipulations. The processed data is then received by the gaming system at 1106.

Then, at step 1108, an inquiry is made as to whether playback of the performance is desired. Playback may be dependent upon the game being played and upon player configuration. If playback is desired, then the process progresses to step 1110 where the performance is recorded and stored for later playback. The process then progresses to step 1112 where the performance is scored according to the pitch and control manipulation timing.

Else, if no playback is desired at step 1108, the process immediately progresses to step 1112 where the performance is scored according to the pitch and control manipulation timing. As previously noted, additional factors may be incorporated in the scoring of a given performance. For example, in games where instruments are used, the scoring may incorporate instrument timing and style as well.

After scoring, the process progresses to step 1114 where the display is updated. Display update may include illustration of the score, a pitch diagram for the player as comparable to the proper pitch guide, and background graphics. The process then ends.

In sum, systems and methods for a voice activated music controller with integrated controls for audio effects is provided. While the disclosed voice activated music controller has been discussed in the field of games, it is also understood that the present voice activated music controller has beneficial use in the field of performing arts, music and audio recording, as a training device for singers, and as a tool for therapists and persons with disabilities.

While this invention has been described in terms of several preferred embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A method for processing an audio signal, useful in association with a voice activated music controller with integrated sound effect controls, the method comprising:

displaying lyrics, sound effect controller cues, and a timing bar to a user;

receiving an audio signal;

receiving at least two non-audio control inputs including a motion sensing signal and a user toggled input, wherein each control input corresponds to a sound effect;

comparing the sound effect controller cues displayed to the user with the timing of the at least two non-audio control inputs to generate a compliance measure; and applying at least two sound effects to the audio signal according to the at least two non-audio control inputs to generate a processed audio signal.

2. The method of claim 1, wherein the at least two sound effects includes at least two of a chorus effect, a pitch modulation, a pitch correction, a harmonizing effect, and a sound bite.

3. The method of claim 1, further comprising transmitting the processed audio signal to a base station utilizing radio frequency.

4. The method of claim 1, further comprising transmitting the audio signal and the at least two non-audio control inputs to a base station utilizing radio frequency.

5. The method of claim 4, further wherein applying at least two sound effects to the audio signal is performed in the base station.

6. The method of claim 5, wherein the transmitted audio signal is interleaved with the transmitted at least two non-audio control inputs.

7. The method of claim 5, wherein the transmitted audio signal is of a different frequency than the transmitted at least two non-audio control inputs.

8. The method of claim 1, wherein the motion sensing signal corresponds to a reverberation sound effect.

9. A voice activated music controller system, useful in association with a player, the voice activated music controller system comprising:

a processor configured to output a display signal comprising lyrics, sound effect controller cues, and a timing bar;

a voice activated controller comprising:

a transducer configured to receive an audio signal;

one or more sound effect controls configured to receive at least two non-audio control inputs including signals from a motion sensor and a user toggled control, wherein each control input corresponds to a sound effect; and a transmitter configured to output the audio signal and the at least two non-audio control inputs to a base station, wherein the base station is a component of a gaming system;

the base station comprising:

a receiver configured to receive the outputted audio signal and the at least two non-audio control inputs; and a signal processor configured to compare the sound effect controller cues with the timing of the at least two non-audio control inputs to generate a compliance measure, and the signal processor further configured to apply at least two sound effects to the audio signal according to the at least two non-audio control inputs to generate a processed audio signal.

10. The voice activated music controller system of claim 9, wherein the at least two sound effects includes at least two of a chorus effect, a pitch modulation, a pitch correction, a harmonizing effect, and a sound bite.

11. The voice activated music controller system of claim 9, wherein the voice activated controller includes an effects processor configured to apply the at least two sound effects to the audio signal according to the at least two non-audio control inputs to generate the processed audio signal.

12. The voice activated music controller system of claim 9, wherein the outputting the audio signal and the at least two non-audio control inputs to the base station utilizes radio frequency.

13. The voice activated music controller system of claim 9, further wherein the coupler is configured to output the audio signal and the at least two non-audio control inputs to the game system.

14. The voice activated music controller system of claim 13, wherein the game system applies the at least two sound effects to the audio signal according to the at least two non-audio control inputs to generate the processed audio signal.

15. The voice activated music controller system of claim 9, wherein the transmitter is configured to output at least one of the audio signal, the at least two non-audio control inputs, and a processed audio signal to the game system.

16. The voice activated music controller system of claim 9, wherein the motion sensor is an accelerometer.

17. The voice activated music controller system of claim 9, wherein the one or more sound effect controls includes buttons.

18. The voice activated music controller system of claim 9, wherein the one or more sound effect controls includes touch pads.

19. The voice activated music controller system of claim 9, wherein the one or more sound effect controls includes roller balls.

20. The voice activated music controller system of claim 9, wherein the one or more sound effect controls includes pressure sensors.

21. The voice activated music controller system of claim 9, wherein the control input for the motion sensor corresponds to a reverberation sound effect.

* * * * *